United States Patent [19]

Del Jiacco

[11] 3,996,849

[45] Dec. 14, 1976

[54] APPARATUS FOR COMPACTION BALING

[76] Inventor: Nicholas A. Del Jiacco, 21296 Greenspray Lane, Huntington Beach, Calif. 92646

[22] Filed: Mar. 1, 1973

[21] Appl. No.: 482,138

[52] U.S. Cl. ..... 100/218; 100/3; 100/244; 100/258 A; 100/269 R; 100/264; 100/DIG. 1

[51] Int. Cl.[2] ..... B30B 15/32; B30B 9/32; B30B 1/32

[58] Field of Search ..... 100/3, 258 A, 218, 269 R, 100/244, 264, 214, 219, 220, 99, DIG. 1

[56] References Cited

UNITED STATES PATENTS

| | | | |
|---|---|---|---|
| 415,909 | 11/1889 | Hackett | 100/218 |
| 467,783 | 1/1892 | Sailor | 100/3 |
| 2,300,339 | 10/1942 | Camerota | 100/258 A |
| 3,469,530 | 9/1969 | Walker et al. | 100/220 X |
| 3,796,150 | 3/1974 | Van Doorn et al. | 100/244 X |

FOREIGN PATENTS OR APPLICATIONS

| | | | |
|---|---|---|---|
| 536,939 | 12/1955 | Italy | 100/3 |
| 176,621 | 9/1961 | Sweden | 100/3 |

*Primary Examiner*—Billy J. Wilhite
*Attorney, Agent, or Firm*—Lyon & Lyon

[57] ABSTRACT

A method and apparatus for the baling of solid waste. The system includes opposed compaction platens which operate to compress waste material within a cavity. The platens also act to eject the bale from the cavity for tying and easy handling. The system further provides for the introduction of more than one charge of material to form a single bale. A hydraulic system is employed within the baling system which allows the platens to cooperate together to present a compressed bale to the tying area under compression and hooks are also employed which both weigh the compacted bale and provide easy forklift removal thereof.

4 Claims, 7 Drawing Figures

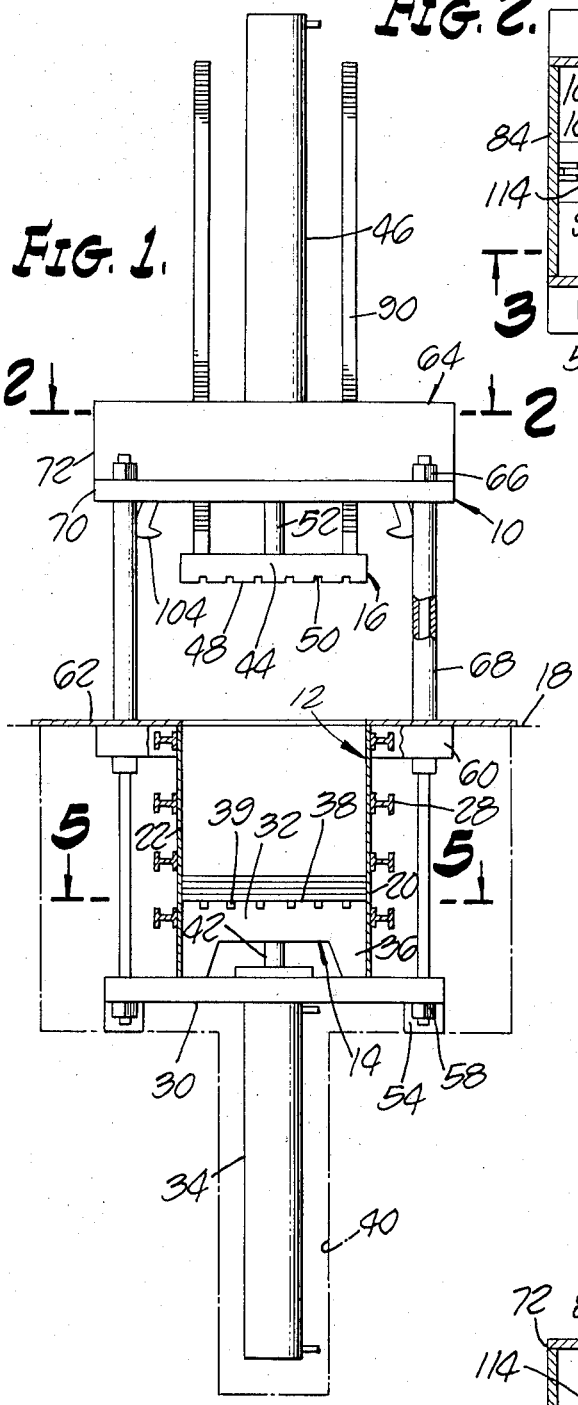
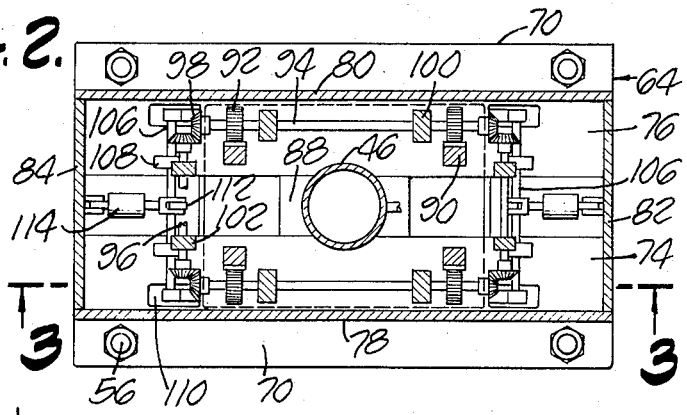
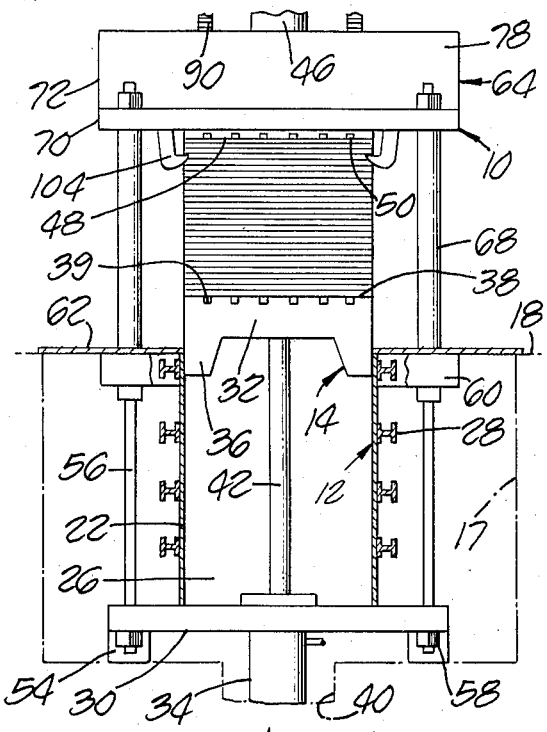
FIG. 4.
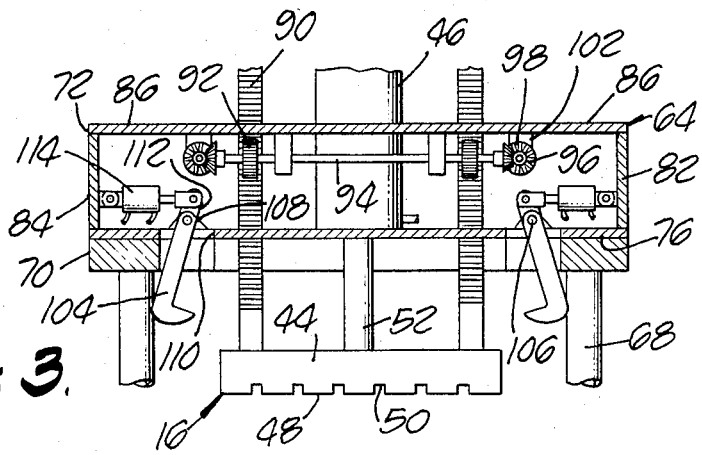
FIG. 3.

APPARATUS FOR COMPACTION BALING

This invention is directed to an apparatus for baling waste material. More specifically, this invention is directed to an apparatus for employing a pair of opposed platens to compress waste material within a cavity and then to cooperate to eject that material therefrom. Further, a device is provided for allowing easy weighing and handling of the completed bale.

Solid waste balers have been successfully employed in such areas as the baling of automobile bodies and components. These devices have generally employed a single compression piston operating within a cavity. In vertically oriented units, this cavity is partially formed by gates which may be opened following compression to allow convenient extraction of the completed bale. In such devices, the final compression is performed within the cavity in the volume partially defined by the access gates. These configurations were necessitated by the resistance of the compacted bale to sliding within the cavity. In such single piston compression systems, the compacted bale cannot be forced away from the final compaction area within the cavity without the chance of bale disintegration. Consequently, to avoid the problem of transporting the bale to a remote access port, access gates have been provided in these single piston compression units to define at least a portion of the volume where final compression of the bale takes place.

Balers employing gates adjacent the final compaction volume of the cavity have several inherent disadvantages. One major disadvantage is that the gates in these units are subjected to extreme stresses during the compaction of the waste materials. As a result, frequent failures are experienced. These failures result in costly downtime and repairs and further subject the operators to potential injury resulting from premature release of the compacted materials.

A second major disadvantage associated with these single piston compression units is that the device is limited to a single charge for each bale formed. The single charge limit is brought about by the fact that the final position of the compressed bale is at the access gates. Consequently, it is impossible to charge further material into the cavity without having to first move the already conpressed material. As a result of this single charge limit, the operator has little control over the size and weight of the final bale and the overall properties of the bale are limited by the size of the cavity. Further, when the cavity is of sufficient size, the operator must make a preliminary determination of how much uncompacted material to use to create a proper sized bale. This is hard to do and often results in odd sized bales.

The present invention provides a novel system for compacting such solid waste materials as junk automobiles. The present system employs two piston compression elements which cooperate to compress and eject the waste material. Further, the present unit provides for the compression of the compacted material at a point in the cavity remote from the access position. As a result, the problems associated with the single piston compression units are overcome. Because the compression does not occur at the same access area of the cavity, the high stresses imposed on access gates and the like are avoided. Further, access gates are altogether dispensed with in the present embodiment.

Accordingly, it is an object of the present invention to provide a baler and a means for baling compactable material which allows for the compaction of the material at a point remote from the access area of the cavity. A system of two opposed pistons are employed which cooperate with a cavity to both compress and eject the material being compacted. The access area of the unit is located at a distance from the compaction cavity.

A second object of the present invention is to provide a baler having the capability of receiving multiple charges for the formation of a single bale. By providing for the compaction of the baled material at a point away from the access area of the unit, more compactable material may be added to the cavity to gain control over the size and weight of the resulting bales. Further, by providing for the multiple charging of the compaction cavity, the overall size of the cavity may be reduced. In single charging units, it was necessary that the cavity be as large as possible in order that a greater latitude as to bale size was available. In the present device, when highly compressible material is being baled, several loadings of the cavity can be made to effect a desired bale. Consequently, a shorter cavity can be employed.

Another object of the present invention is to provide a baler which is capable of retaining compression on the compacted material while transporting that material to a tying position. The present device allows for the actuation of the piston means to transport the compressed bale from the compaction cavity to the access area while retaining the bale in compression by means of a relief valve associated with the drive means of the piston means. This bale may then be tied at the access area before the compression load is completely released from the bale. This greatly enhances the handling capability of compacted material which might otherwise disintegrate before tying.

A further object of the present invention is to provide a convenient access area which is readily accessible to forklifts and other handling apparatus. The pistons operate to eject the completed bale from the compaction cavity to a position at ground level not surrounded by gates and other restraining devices normally associated with such vertical balers. Further, a system is provided which allows the retraction of the lower support for the bale for easy insertion of the tongs of a forklift.

Another object of the present invention is to provide a means for suspending a finished bale for weighing and easy removal by a forklift or other handling apparatus. Hooks are provided which may be mounted to the frame of the compaction unit through load cells. The hooks suspend the bale from the load cells to allow weighing of the bale and access beneath the bale.

Thus, an improved baling system is presented which allows for the compression of compactable material within a cavity at a position distant from the access area of the unit. This configuration allows for multiple charging of the unit and permits the elimination of access gates. The device also provides for improved handling and weighing of the completed bale through the use of hooks. Further objects and advantages will become apparent from the description herein.

FIG. 1 is a side view of the compaction unit with the compaction cavity in cross-section.

FIG. 2 is a top view in cross-section taken along line 2—2 of FIG. 1 illustrating the alignment mechanism of the compression assembly.

FIG. 3 is a side view of the alignment mechanism and the hooking mechanism taken in cross-section along line 3—3 of FIG. 2.

FIG. 4 is a side view of the baling system showing a compressed bale in the access area.

Figure 5:
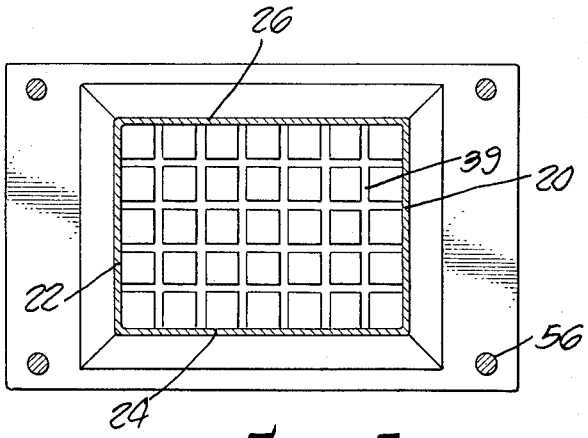
FIG. 5 is a cross-sectional plan view taken along line 5—5 of FIG. 1 illustrating the platen surface.

Turning now to the drawings, a heavy-duty baler is disclosed. The baler generally consists of a frame 10, a compaction cavity 12, an ejection means 14, and a compression means 16. The entire unit is vertically disposed and is partially positioned in a vault 17 below ground level indicated by line 18.

Figure 7:
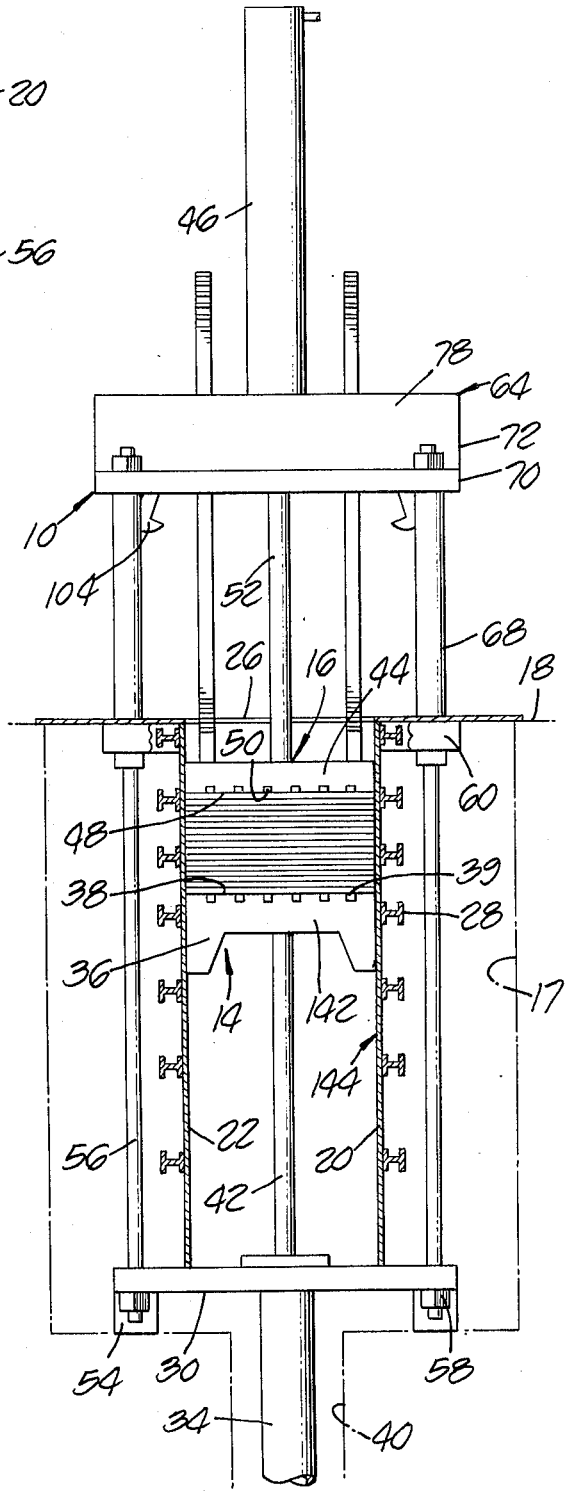
FIG. 7 is a side view of the compaction unit illustrating its employment.

The compaction cavity 12 is of rectangular cross-section as best seen in FIG. 5. The cavity has four walls 20, 22, 24 and 26 which extend vertically into the vault 17. I-beams 28 structurally support the cavity against the reaction loads of the material being compressed within. The cavity is open at ground level and is closed at its lower end by a lower frame member 30. The rectangular cross-section of the cavity is not essential to the operation thereof. However, the most convenient form for completed bales is a rectangular structure. Consequently, the rectangular shape of the cavity 12 is preferred. The cavity 12 may be of any convenient depth and should be determined by its intended use. When the device is intended to be used with material which is highly compressible, a deeper cavity is more convenient. In the present invention it is only necessary that the cavity be of sufficient depth to enclose the ejection means, a compacted bale and a short compaction space above the bale. Because the system is able to receive multiple charges in the formation of a single bale, a deep cavity is not required. FIG. 7 illustrates a system of the present invention which incorporates a deep cavity. Such deep cavities were originally incorporated with single piston devices where multiple charges were impossible.

An ejection means is provided within the cavity 12 to raise the compressed bale from the cavity for convenient tying and removal thereof. One device for providing such an ejection system includes a platen 32 which is actuated by a drive means 34. The platen 32 has a rectangular plan which slidably fits within the compression cavity 12. The ejection platen 32 has extensions 36 at the four corners thereof to guide the ejection platen 32 in the compression cavity 12. The platen 32 has a compression surface 38 which directly operates on the compactable material. This compression surface 38 has channels 39 cut therethrough for convenient threading of wire or straps to tie the bales.

The ejection platen 32 is centrally attached from below to the ejection drive means 34. The ejection drive means 34 is most advantageously designed to forcefully move the platen 32 from the structural base member 30 to a position where the compression surface 38 of the platen 32 extends above the ground level 18. FIG. 4 illustrates the ejection platen 32 with the compression surface 38 extending above ground level 18. The drive means 34 may conveniently include a hydraulic cylinder conveniently designated 34. The hydraulic cylinder 34 extends through the structural base member 30 and is affixed thereto. A well 40 is provided through the floor of the vault 17 to accommodate the cylinder 34. The cylinder 34 further includes a piston 42 which is attached to the under side of the platen 32. When the cylinder 34 is incorporated with a standard cavity 12, it is not necessary that the cylinder 34 and the piston 42 be of sufficient strength to support the total compression loads exerted by the means 16. Instead, the compression loads may be supported by the structural base member 30 through extensions 36. Consequently, it is only necessary that the hydraulic cylinder 34 be capable of acting against the compression means 16 at a reduced load to lift the completed bale from the cavity 12. Naturally, a plurality of such cylinders 34 may be employed if desired.

The compression means 16 is positioned opposite the ejection means 14 to compress compactable material against the compression surface 38 of the ejection platen 32. The compression means 16 is most conveniently provided by a compression platen 44 and a compression drive means 46. The compression platen 44 is rectangular and slidably fits within the cavity 12. A compression surface 48 defines the bottom of the compression platen 44 and operates directly on the compactable material to form bales. Grooves 50 are provided in the compression surface 48 to allow tying of the bale with the compression platen 44 positioned thereon. The grooves 50 are identical to the grooves 39 illustrated in FIG. 5.

The drive means 46 is provided as a means for forcefully driving the compression platen 44 against the compactable material within the cavity 12 to form bales. The drive means 46 further acts to retract the platen 44 upward to a position above the top of the cavity 12. The compression drive means is conveniently provided by a hydraulic cylinder 46 positioned in the frame 10. The hydraulic cylinder 46 is mounted so that a piston 52 operatively extends downward therefrom. The piston 52 is attached to the compression platen 44 at a central location. The drive means 46 as well as the drive means 34 may be supplied by other driving elements such as a screw when hydraulic control is not convenient.

The frame, generally designated 10, provides the base for both the compression drive means 46 and the ejection drive means 34. The ejection drive means 34 is mounted in the structural base member 30. The structural base member 30 is positioned at the bottom of the vault 17 and thereby forms one support base for the unit. The structural base member 30 includes feet 54 which are fixed to the vault thereby forming a basic support for the frame 10. The base structure 30 further includes a box frame which supports the ejection drive means 34. Near the four corners of the structural base member 30, four tension rods 56 are fixed in place by fasteners 58. Further, the base support structure 30 supports the four walls 20, 22, 24 and 26 of the compaction cavity 12. The tension rods 56 extend upward from the structural base member 30 to an intermediate structural platform 60. The intermediate structural platform 60 may be formed by two or more rigid members welded horizontally along at least two sides of the cavity 12. These members forming the intermediate platform 60 may consist of two I-beams each being welded along one base to the sides 24 and 26 of the compaction cavity 12. These intermediate beams 60 act to support the cover plates 62 which are arranged about the compaction unit to cover the concrete vault located thereabout. Further, the beams 60 have positioned therethrough the four tension rods 56 which continue upward from the structural base member 30 through the intermediate platform 60 formed by the I-beams. The four tension members 56 terminate at a crown 64 which is spaced above the ground level 18 at a distance greater than the maximum height of a bale. The tension members 56 are held in place by end fasteners 66 to the crown 64. Further, the crown 64 is spaced from the intermediate platform 60 by spacer tubes 68. The spacer tubes 68 are positioned over the tension rods 56. The diameter of the spacer tubes 68 prevents them from passing through the beams of the platform 60 or the crown 64.

The crown 64 includes box members 70 which run the width of the crown and support the tension rod 56. Interior of the box members is a housing 72. The housing 72 includes two base plates 74 and 76, two side walls 78 and 80 and two end plates 82 and 84. Further, a top 86 is fastened to the housing 72. The crown assembly 64 supports the compression means 46 by plate 88 which is welded to the housing at base plate member 74 and 76. Thus, a frame structure is provided which includes a structural base member 30, an intermediate platform 60 and the crown 64. Further, tension rods 56 extend from the structural base member 30 to the crown 64 and spacers 68 separate the crown 64 from the intermediate platform 60. The tension rods 56 operate to prevent the crown from separating upward from the structural base member 30 when the compression platen is operating to compact material resting on the ejection platen. As the platens exert compression forces on the compactable material, the tension rods 56 act in tension to hold the frame 10 together.

A means for guiding the compression platen 44 is provided within the crown 64. This guide means includes four vertically oriented racks 90 which are fixed to the top side of the compression platen 44. These vertically oriented racks 90 engage four spur gears 92 which are rotatably mounted within the crown 64 to the underside of the cover 86. The four spur gears 92 are constrained to rotate together by a rectangular system of rotatably mounted shafts 94 and 96 and eight miter gears 98. The shafts 94 extend along the underside of the cover plate 86 parallel to the side members 78 and 80 of the crown 64. These shafts 94 are rotatably fixed to the cover plate 86 by means of bearings 100. Miter gears 98 are positioned at either end of the two shafts 94. These miter gears 98 engage mating miter gears 98 fixed to either end of the two rotatably mounted shafts 96. The shafts 96 are also rotatably mounted to the underside of the cover 86 by bearings 102. Thus, a rectangular system of shafts and miter gears cause the four spur gears 92 to rotate together. The constrained rotation of the spur gears 92 results in the uniform travel of the vertical racks 90 engaged to the spur gears 92. By constraining the vertical racks 90 to move in unison, the compression platen 44 is retained in line. In this manner, excessive bending and twisting loads are not imposed on the compression drive means 46.

Also mounted within the crown 64 are bale support means. Four bale hooks 104 are pivotally mounted to the base plates 74 and 76 on two shafts 106. The shafts pivot in mounts 108. The bale hooks 104 extend through slots 110 to engage the compacted bale as best shown in FIG. 4. Two hooks 104 are provided on each of the two shafts 106 which are in turn actuated by means of control arms 112. The control arms 112 are actuated by hydraulic cylinders 114 which are pivotally attached at one end to the end walls 82 and 84 of the crown 64 and at the other end to the arms 112.

Figure 6:
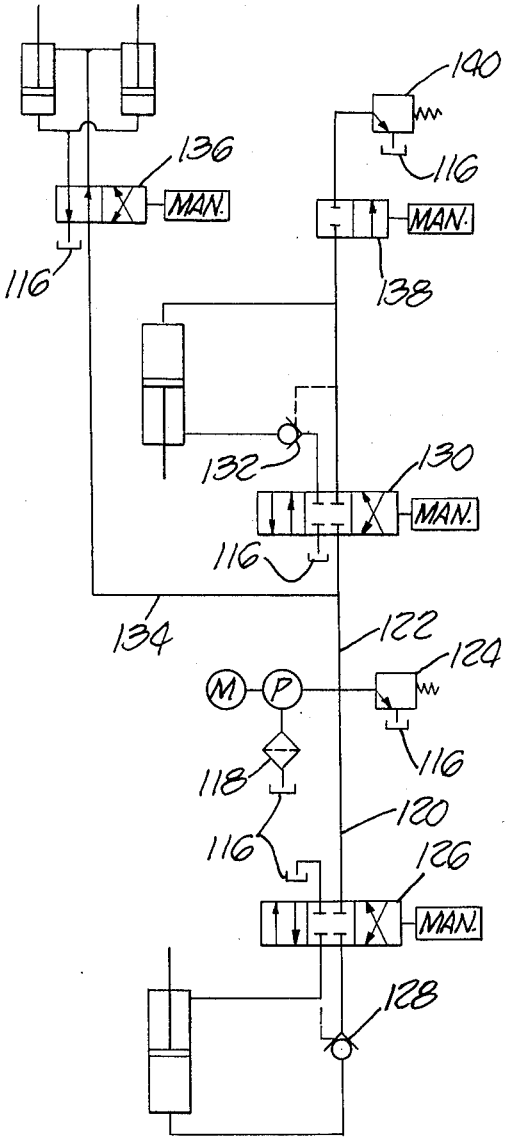
FIG. 6 is a schematic of the hydraulic system employed with the present device.

The hydraulic system for the unit is illustrated in FIG. 6. The pump P is driven by a motor M to extract hydraulic fluid from a reservoir 116 through a filter 118. The pump P acts to drive four hydraulic elements in the present embodiment. The pump drives the ejection drive means 34, the compression drive means 46 and the two bale support drive means 114. To accomplish this, the pump distributes hydraulic force through two main channels 120 and 122. A relief valve 124 is provided as a safety precaution. The first main line also extends to a mutually operated valve 126. The valve 126 may be positioned in the no-flow condition as shown. Alternately, the valve may be shifted to the right to cause the ejection drive means to raise the ejection platen 32. When the valve 126 is moved to the left, the cylinder 34 causes the ejection platen 32 to move downward. The pilot check valve 128 prevents dead weight settling of the ejection drive means 34. A second valve means 130 may be positioned in the no-flow mode as shown. When the valve 130 is moved to the right, the compression means 46 causes the compression platen 44 to move downward. When the valve 130 is moved to the left, the compression platen 46 is caused to move upward. A second pilot check valve 132 prevents the deadweight settling of the compression cylinder 46.

A third hydraulic channel 134 extends to the hook pistons 114. A third valve 136 operates to either hold the hooks in the clamped position or in the retracted position.

A final valve 138 is provided on the hydraulic line which provides the downward compression force to the compression drive means 46. This valve 138 may be opened to allow hydraulic connection with a pressure relief valve 140. This pressure relief valve 140 may be set to release at a predetermined pressure within the hydraulic compression line. Thus, when the valve 126 to the ejection cylinder 34 is moved to the right, the valve 130 to the compression cylinder 46 is left in the no flow position, and the relief valve actuating valve 138 is moved to the left, the pump P can drive the bale upwards out of the compaction cavity 12. This is accomplished because the relief valve 140 will allow the pressure built up within the compression cylinder 46 to be relieved as the system moves upward. By setting the relief valve 140 at a predetermined pressure, the compression cylinder 46 will retain a calculated force therein which results in a compression force in the platen 44 acting downward on the bale. Thus, the ejection platen 32 is capable of moving the bale upward out of the compaction cavity 12 while retaining sufficient compression on the bale to prevent the bale from falling apart. Once the bale is brought out of the compaction cavity 12, it can be tied or strapped by means of the channels 39 and 50 cut into the ejection platen 32 and the compaction platen 44 respectively.

To summarize the overall operation of the system, compactable material is positioned within the compaction cavity 12 with the ejection platen 32 at the bottom of the cavity 12 and the compaction platen 44 raised upward out of the way. The compaction platen 44 is then forced downward to compress the material located within the compaction cavity 12. Once this material has been compacted, the resulting bale can be ejected or further material added thereto. To add further material to the bale, the compaction platen 44 is raised out of the way and more material is inserted in the compaction cavity 12. The compaction platen 44 is then again forced downward to compress the material within the cavity 12. This process may be repeated until a desired bale is formed. After the proper bale is formed, the compaction platen 44 is retained on the compressed material and the relief valve 140 is set to the desired pressure. The ejection platen 32 is then energized through the cylinder 34 and the bale is forced upward from the compaction cavity 12. When the ejection platen 32 has reached a point where the compression surface 38 is above the ground level 18, the system is stopped and the bale is tied or strapped through the grooves 39 and 50. The bale hooks 104 may then be engaged with the bale and the ejection platen 32 lowered to ground level 18. The ejection platen 32 is left at ground level 18 to prevent equipment and men from falling into the cavity 12. With the bale suspended by the bale hooks 104 a forklift may be brought in beneath the bale. The hooks 104 may then be retracted allowing the bale to come to rest on the forklift. The forklift can then transport the completed and tied bale away from the baling unit. The unit is then ready for a second baling operation.

The present invention is further capable of operating on existing cavities as shown in FIG. 7. The existing cavities are substantially deeper than that required for the present invention because these cavities were only allowed a single charge. The present invention may be operated with such a deep cavity by raising the lower platen 142 part way up the cavity 144. When the system is to be regularly employed for the compaction of highly compactable materials, it is considered advantageous to have the deeper cavity 144. In such an instance, the lower platen 142 can be lowered to the full depth of the cavity 144 and a great volume of material may be charged to the cavity 144. The compression platen 144 may then be brought downward into the cavity 144 and the lower platen 142 raised until a compressed bale is formed. If further charging is desired, the compression platen 44 may then be raised upward and more material charged to the cavity 144.

Thus, an improved baling system is disclosed which employs two opposed platens which compress material within a compaction cavity and then causes the resulting bale to be removed from the cavity without the use of gate structures or other disfavored devices. A means is also provided for retaining the bale in compression during extraction from the compaction cavity. Moreover, a bale suspension system is provided which allows a forklift or other appropriate vehicle to quickly and easily remove the completed bales. Further, a weighing system is provided.

While embodiments and applications of the invention have been shown and described, it would be apparent to those skilled in the art that many more modifications are possible without departing from the inventive concepts herein described. The invention, therefore, is not to be restricted except as it necessary by the prior art and by the spirit of the appended claims.

What is claimed is:

1. A baler for compressing compactable material into bales, comprising a vertically disposed cavity defined by a structurally reinforced box, said cavity being open at the top;

an ejection platen sized to fit within said cavity;

ejection drive means extending below said cavity for driving said ejection platen vertically in said cavity between a position at the bottom of said cavity and a position just above the top of said cavity;

a frame, said frame being fixed relative to said cavity;

a compression platen sized to fit within said cavity, said compression platen being disposed opposite said ejection platen;

compression drive means fixed to said frame above said cavity for driving said compression platen vertically between a position displaced from said cavity for access to said cavity and a position near the bottom of said cavity for compressing compactable material against said ejection platen; and a control system for operating said ejection drive means and said compression drive means, said control system providing a constant force device operably connected to said compression drive means to allow said ejection drive means to eject said bale while maintaining a preselected pressure on said bale through said compression drive means.

2. The device of claim 1 wherein said baler further comprises guide means for guiding said compression platen, said guide means preventing misalignment of said compression platen.

3. The device of claim 2 wherein said guide means includes vertically disposed racks fixed to said compression platen; and means mounted to said frame for constraining said racks to move together when said compression platen is moved.

4. The device of claim 1 wherein said bale further includes bale support means mounted on said frame for retaining said bale at a distance from said cavity without other means of support.

* * * * *